US005463449A

United States Patent [19]

Morse et al.

[11] Patent Number: 5,463,449

[45] Date of Patent: Oct. 31, 1995

[54] REDUCTION IN METALLIZATION OF A PIEZOELECTRIC SENSOR FOR A XEROGRAPHIC DEVELOPMENT PROCESS TO INCREASE SENSITIVITY OF THE SENSOR

[75] Inventors: Theodore H. Morse, Rochester; Donald S. Rimai, Webster; Martin Potucek; Sven Sonnenberg, both of Rochester, all of N.Y.

[73] Assignee: Eastman Kodak Company, Rochester, N.Y.

[21] Appl. No.: 167,674

[22] Filed: Dec. 15, 1993

[51] Int. Cl.[6] ..... G03G 15/08

[52] U.S. Cl. ..... 355/203; 355/246; 310/365

[58] Field of Search ..... 355/203, 246; 310/365, 369; 73/DIG. 4, 290 V

[56] References Cited

U.S. PATENT DOCUMENTS

| | | | |
|---|---|---|---|
| 2,249,933 | 7/1941 | Bechmann | 310/365 |
| 4,987,453 | 1/1991 | Laukaitis | 355/246 |
| 5,006,897 | 4/1991 | Rimai et al. | 355/246 |
| 5,124,752 | 6/1992 | Kanno et al. | 355/253 |
| 5,160,966 | 11/1992 | Shiina et al. | 355/206 |

OTHER PUBLICATIONS

Daley, P. S. and Lundgren, P. A., *American Industrial Hygiene Association Journal,* vol. 36, 1975, pp. 518–532.

Ho, Mat. H., "Applications of Quartz Crystal Microbalances and Aerosol Mass Measurement", Chapter 10, pp. 351–388, from the book: *Methods and Phenomena; Their Applications in Science and Technology.*

Sauerbrey, Gunter, *Zeitschrift fur Physik,* vol. 155, 1959, pp. 206–222.

Sauerbrey, G., *Zeitschrift fur Physik,* vol. 178, 1964, pp. 457–471.

Sem, G. J., Daley, P. S., Lundgren, P. A., Harris, F. S., Jr., Marlow, W. H., Lippman, M., Clark, W. E., and Durham, M. D. (editors); "Performance Evaluation of a New Piezoelectric Aerosol Sensor", *Aerosol Measurement,* University Press of Florida, Gainesville, Fla., 1979, pp. 672–686.

Sem, G. J., Tsurubayashi, K., and Homma, K., *American Industrial Hygiene Association Journal,* vol. 38, 1977, pp. 580–588.

*Primary Examiner*—Joan H. Pendegrass
*Attorney, Agent, or Firm*—Dennis R. Arndt

[57] ABSTRACT

A piezoelectric toner mass sensor to be positioned adjacent to a toner applicator in an electrostatographic recording apparatus. The piezoelectric sensor has a circular central crystal having its front and rear surfaces metallized, the two metallized surfaces being concentric with one another. The front surface of the sensor directed toward the toner applicator is smaller than the rear surface. Reducing the area of metallization on the piezoelectric toner mass sensor greatly increases sensitivity of the device. In addition, limiting the development area on the sensor facilitates the cleaning of the piezoelectric element and facilitates the mounting of the sensor in a suitable holder.

12 Claims, 3 Drawing Sheets

REDUCTION IN METALLIZATION OF A PIEZOELECTRIC SENSOR FOR A XEROGRAPHIC DEVELOPMENT PROCESS TO INCREASE SENSITIVITY OF THE SENSOR

BACKGROUND OF THE INVENTION

1. Technical Field of the Invention

This invention relates generally to the measurement of toner particle mass deposition, deposition rate, and charge-to-mass ratio in electrostatographic reproduction apparatus such as copiers and/or printers. More particularly, it relates to improvements in an apparatus for monitoring certain properties which characterize the electroscopic toner particles used in electrostatographic recording devices to develop electrostatic charge patterns and images.

2. Description of the Prior Art

Electrostatographic apparatus, such as electrophotographic copiers and printers which use a dry powder toner to develop latent images, usually require some type of monitoring and controlling device for maintaining consistency in the quality of the developed image. Toner concentration monitors are frequently used and a variety of systems are seen and described in the prior art. The need for such systems is especially important when the size of the toner particle is reduced to allow for higher resolution in the developed image.

In an article G. J. Sem, K. Tsurubayashi and K. Homma, J. Am. Ind. Hyg., Assoc. Vol. 38, p. 580 (1977), the use of a piezoelectric microbalance is disclosed as a respirable aerosol sensor. In that study, a 5 MHz AT cut quartz transducer was used to sense the presence of various types of industrial contaminants including $CaCO_3$ particles, welding fumes, cotton mill dust, powdered metal, and tobacco smoke. The particle concentration investigated in that study was (0.05–5.5 mg/$M^3$), which is far lower than that encountered in xerographic conditions. There was no discussion in that article of the sensitivity of the disclosed device at higher particle concentrations. In fact, their discussion of the limits of sensor loading (page 588) suggests that the device would not function in a xerographic development station. Also disclosed in their results was the fact that it only applies to 3.5 micron diameter particles. In contrast, a piezoelectric development sensor is designed to work with toner particles having diameters between approximately 1.0 and 15 microns.

G. Sauerbrey, *Zeitschrift fur Physik*, Vol. 155, 1959, p. 206 and G. Sauerbrey, *Zeitschrift fur Physik*, Vol. 178, 1964, p. 457 reported that for transducers comprising a free-standing quartz plate, the sensitivity of the transducer to the presence of particles increased towards the center of the transducer.

U.S. Pat. No. 5,006,897, issued in the name of Rimai et al on Apr. 9, 1991, is directed to an apparatus used to detect the mass deposition rate of toner particles during the xerographic development process. Specifically, the front surface of the piezoelectric element is placed in close proximity to the development station containing xerographic developer. The front surface of the piezoelectric element is biased so as to attract toner from the development station. In addition, an AC bias is superimposed onto the DC bias at the resonant frequency of the piezoelectric element. By measuring the shift in resonant frequency, the mass of the deposited toner and the mass deposition rate can be determined. After depositing the toner mass onto the front surface of the piezoelectric element, the bias voltage is reversed and the action of the development station removes the toner, thereby preparing the sensor for subsequent measurements.

In order for this sensor to function properly, it must be firmly clamped into a fixed position so as to preclude the occurrence of artifacts induced by spatial variations or vibrations of the sensor. As is well known, clamping a piezoelectric transducer significantly alters its response to either an applied electrical or mechanical signal. In addition, it is necessary to preclude the deposition of toner particles from the side of the transducer opposite the front surface of the transducer, i.e., the rear surface. This requirement further complicates the necessary clamping and clamping fixtures and can further affect the response of the transducer.

It is necessary to bias the front surface of the transducer in order to attract toner. The application of such a bias can result in a mechanical constriction of the transducer, thereby giving rise to so-called "piezoelectric stiffening". This will affect the response of the transducer to further mechanical stresses or loads. Finally, it is necessary to remove the toner particles from the transducer following a measurement. Because of the necessary interactions between the transducer and the development station in order to effect such cleaning, toner deposition outside of the developer nap must be avoided.

As mentioned above, for use as a xerographic development sensor, the front surface of the transducer must be biased in order to attract toner. This is in marked contrast to the aerosol sensors discussed above where random deposition of the particles on the sensor surface takes place. As a consequence, it would appear that reducing the area of metallization on the front surface of the xerographic development sensor would actually reduce the amount of toner deposited onto the transducer and less toner deposition would be expected to result in less variation of the shift in resonant frequency of the device and would suggest that, by reducing the metallization, the device should be less sensitive.

SUMMARY OF THE INVENTION

It is an object of the present invention to provide an improved apparatus and method for determination of the toner particle mass deposition, deposition rate, and charge-to-mass ratio, charge-to-toner particle mass in an electrostatograph apparatus.

In accordance with the present invention, it was found that by limiting the size of the development electrode on a piezoelectric toner mass sensor, the sensitivity to the developed mass could be increased. It was a surprise and contrary to conventional thinking, that by reducing the area of metallization on a piezoelectric toner mass sensor, greater sensitivity of the device was actually found to occur. Limiting the development area also facilitates the cleaning of the piezoelectric element and facilitates mounting the element in a suitable holder.

The present invention further provides a piezo device to be positioned adjacent a toner applicator in an electrostatographic recording apparatus to attract toner particles. The device of the present invention comprises a circular control crystal having metallized first and second surfaces with the second surface directed toward the toner applicator and the second metallized surface being concentric with and smaller than the first surface.

The present invention provides even further an electrostatographic recording device in which latent electrostatic images on an image-recording element are developed by a toner applicator which operates to apply a mass of electrostatically charged toner particles to the image-bearing surface of the image-recording element, the toner applicator being electrically biased to a predetermined potential and including an apparatus for determining the rate at which toner particles are applied to the image recording. The apparatus including a piezo device having first and second opposed metallized surfaces positioned with the second surface adjacent the toner applicator to attract a mass of toner particles. Means are provided for selectively biasing the piezo device to a predetermined potential to cause a monolayer of toner particles to be deposited on the second metallized surface. Means are also provided for selectively sensing the rate of toner deposition on the second surface by repeatedly sensing the change in resonant frequency of the piezo device wherein the area of the first metallized surface is greater than the area of the second metallized surface thereby increasing the sensitivity to the mass of the toner particles disposed on the piezo device.

The invention and its advantages will be better understood from the ensuing detailed description of preferred embodiments, reference being made to the accompanying drawings.

DETAILED DESCRIPTION OF THE PREFERRED EMBODIMENTS

This disclosure will be directed, in particular, to elements forming part of, or cooperating more directly with, an apparatus in accordance with the present invention. It is to be understood that elements, components, and/or sub-components not specifically shown or described may take various forms well known to those skilled in the electrostatographic art.

Figure 1:
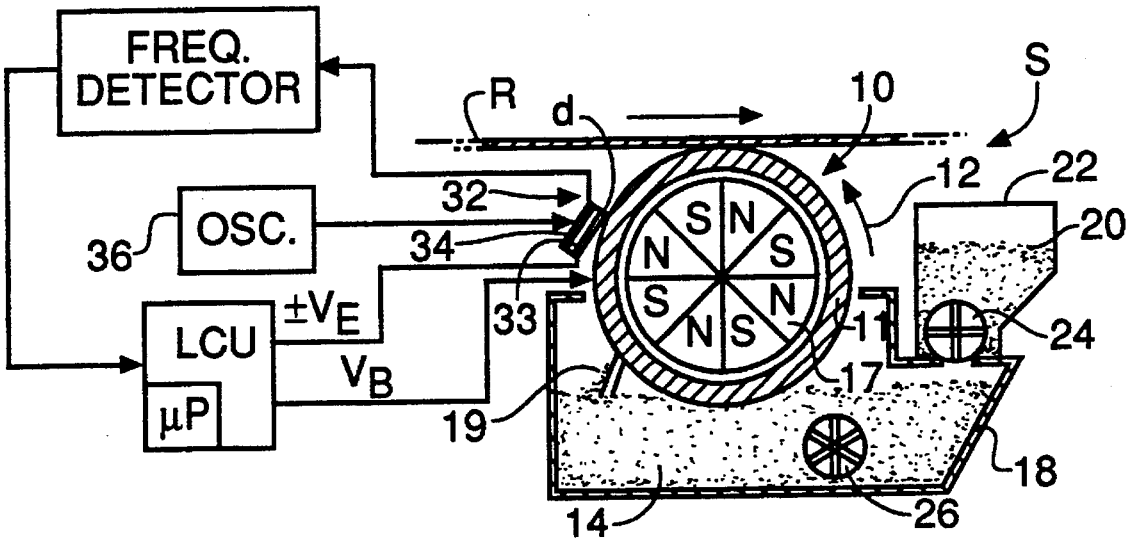
FIG. 1 is a schematic illustration of a preferred embodiment of the apparatus of the invention.

In FIG. 1, the apparatus of the invention is shown embodied in a conventional magnetic brush-type development station S of the type which operates to apply a mass of electrographic toner particles to an electrostatic latent image previously formed on a recording element R to effect the development of such an electrostatic latent image. The development station may form part of an electrostatographic image-recording apparatus, such as an electrophotographic document copier or printer. From the ensuing description, it will be appreciated that the apparatus of the invention is also useful in other types of toner-applying devices.

The development station S of FIG. 1 includes a magnetic brush 10 comprising a non-magnetic, electrically-conductive sleeve 11 which may be rotatably driven in the direction of the arrow 12 to transport a developer 14 from a hopper 18 into contact with the recording element. The developer typically comprises a two-component mixture of pigmented, thermoplastic toner particles and magnetically attractable carrier particles. The carrier particles are magnetically attracted toward the outer surface of sleeve 11 by an internal magnetic core piece 17 which may or may not rotate. Each carrier particle usually supports a large number of toner particles which are considerably smaller than the carrier particles and adhere thereto by triboelectric forces. The toner particles themselves are usually charged to a polarity opposite that of the charge pattern being developed on the photoconductor R and, during contact with the charged pattern, the toner particles are stripped from the carrier particles by the stronger electrostatic force of the charge pattern, and deposited on the recording element R. The partially denuded carrier particles are then scraped from the brush surface by a skive 19 and returned to the hopper 18. There, the carrier particles are mixed with a fresh toner 20 supplied from a sump 22 via a valve or gate 24. The latter is controlled by a microprocessor-based logic and control unit (LCU), which is suitably programmed in a conventional manner to adjust all process parameters, as needed. A mixing auger 26 serves to mix the carrier with toner and thereby refreshes each (partially denuded) carrier particle with new toner. As is common, the magnetic brush 10 is electrically biased to a suitable reference voltage $V_b$ to prevent the development of the background areas of the charge pattern. The level of the brush bias voltage depends on the primary charge level on the recording element, and the level of exposure received by the recording element. As shown, the brush bias voltage is provided by the LCU and is typically between about 100 and 500 volts.

As indicated above, a key parameter in controlling the quality of images produced by the electrostatographic recording apparatus is the instantaneous value of the development rate of the toner used to develop the charge pattern. This parameter continuously undergoes change and, unless controlled or otherwise compensated for, will dramatically affect the image quality.

In accordance with the present invention, a preferred apparatus for selectively determining the development rate of the toner particles being applied by the development station of FIG. 1 comprises a piezoelectric crystal 32 having opposed electrodes 33, 34, hereinafter referred to as the piezoelectric transducer, disposed on its respective opposing faces. The details of the piezoelectric member are disclosed in the aforementioned U.S. Pat. No. 5,006,897, the contents of which are incorporated herein by reference. At selected time intervals, the LCU applies a bias voltage of opposite polarity to electrode 33 causing it to either attract or repel toner particles, depending on the charge polarity of the toner. The oscillator circuit 36, it is operatively coupled to the piezoelectric transducer to cause it to oscillate at its nominal resonant frequency (e.g., 1 MHz). The resonant frequency of oscillation of crystal 32 depends on the mass of the piezoelectric transducer, the greater the mass, the lower the frequency. Crystal 32 is supported in a position closely spaced, (e.g., within about 0.05 cm.) from the outer surface of the brush sleeve 11 whereby electrode 33 forms one plate of a capacitor circuit in which the brush forms the other plate and the intervening developer mass provides the dielectric material.

The rate at which the toner accumulates on electrode 33 depends on the toner concentration, $T_c$, in the developer mix, the charge-to-mass ratio of the toner, and the operating characteristics of the development station. Of course, the rate of deposition (i.e., accumulation) of toner on electrode 33 is directly proportional to the rate at which the toner develops the charge pattern on the recording element R. By sampling the toner mass at any two or more different times occurring during the substantially linear portion of the curve where the toner is gradually depositing at a substantially uniform rate, the development rate of the toner can be determined from the slope of such a curve. Preferably, the bias voltage $V_b$ selectively applied to the electrode 33 by the LCU is chosen so that, when the toner charge is as low as it is likely to become, no more than a monolayer of toner particles will be deposited on the electrode surface before the electric field produced by the bias voltage on the electrode is neutralized by the deposited toner. By determining the toner mass at saturation, the charge-to-mass ratio $q/m$ of the toner can be determined from the equation:

$$\frac{q}{m} = \frac{2V\epsilon A}{md}$$

wherein this case, V is the net bias voltage applied to the electrode (i.e., the difference between the respective bias voltage is applied to the toner applicator and the electrode); $\epsilon$ is the dielectric constant of the layer of toner particles, A is the area of the electrode on which the toner particles are deposited, and d is the average diameter of the toner particles. The charge-to-mass determination is the subject matter of U.S. Pat. No. 5,006,897.

In the above equation, all parameters, except for the toner mass m are known, making a simple matter for the microprocessor to calculate q/m after the toner mass at saturation has been determined. It will be appreciated that the value of the toner mass accumulated by the electrode 33 is charge-dependent. The larger the toner charge, the smaller the toner mass required to neutralize the electrode bias.

Clearly, it can be seen from the intended use of the piezoelectric toner monitor that maximum sensitivity of the monitor depends on the mass deposited for a given bias voltage applied to the electrode. Moreover, it seems intuitive that, by maximizing the area of the transducer covered by the electrodes, maximum toner mass for a given bias voltage is deposited. It would then be expected that by maximizing the area of electrode 33 of said transducer, that maximum sensitivity of the piezoelectric device should be achieved.

In fact, the opposite is true. This can be readily demonstrated by mapping the frequency response of a shear cut transducer such as the AT cut quartz transducers referred to in the above discussion. It was found that the central area of this transducer gives a larger change in the resonant frequency of the transducer for a given applied load than does the outer portion of the transducer. If the toner deposition is restricted to the central portion, then a greater change in the resonant frequency of the transducer to a given mass of toner has been found than if the toner were allowed to be deposited randomly across the entire transducer.

Clearly, it was found that the deposition of the toner can be restricted by limiting the size of the electrode. Preferably, it was found that when the radius of electrode 34 is at least as great as the radius of electrode 33, and while maintaining concentricity of said electrodes, the radius of the electrode 33 should be between approximately ⅖ and ⅔ of the radius of the transducer. Smaller electrode radii may not allow for sufficient area for mass deposition and larger radii approach the radius of the transducer. In addition, the active area of the transducer should be maximized by locating the center of the front electrode to being concentric with that of the electrode on the opposing surface.

EXAMPLE

Figure 2:
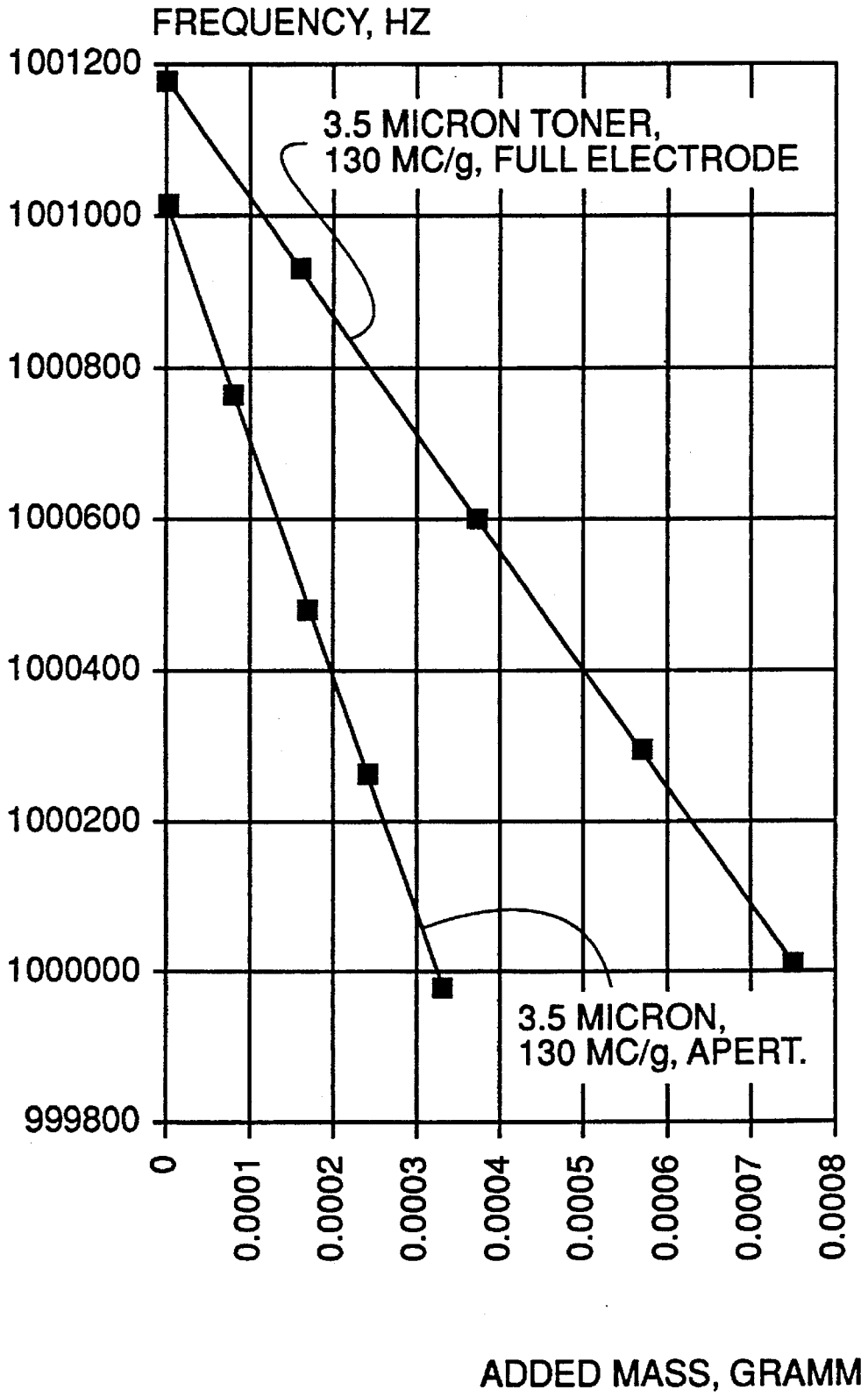
FIG. 2 is a graph of frequency in Hz versus added mass in grams comparing a full electrode with an electrode having reduced metallization.

A piezoelectric toner monitor was made using a nominal 1 MHz AT cut quartz transducers, with both electrodes having 0.645 inch diameters. In one example, the transducer electrodes 33 and 34 covered their entire surface, whereas on a second example, the diameters of the electrodes 33 and 34 were reduced to approximately 0.33 inches, or 51% of the transducer diameter. The monitors were alternately placed above a xerographic development station, variably biased to attract different amounts of toner, and toner particles having nominal volume weighted diameters of approximately 3.5 microns, were deposited. After deposition, the shift of the resonant frequency of the transducer was recorded and the mass removed and weighed. As can be seen from the graph in FIG. 2, the magnitude of the slope of the resonant frequency as a function of toner mass is 2.05 times greater for the transducer with the reduced electrode than it is for the transducer with the larger electrode, indicating an increase in the sensitivity to toner mass of approximately 105%.

Figure 3:
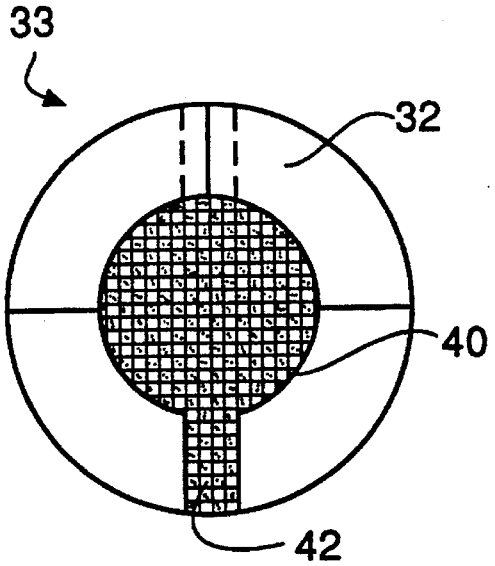
FIG. 3 is an enlarged view of the piezo device which is a preferred embodiment of the present invention.

FIG. 3 illustrates a typical transducer having its front, the developer contacting surface, exhibiting reduced metallization. For this device, any suitable piezoelectric element such as those described in previous disclosures can be used. The preferred embodiment incorporated in AT cut quartz transducers having a nominal resonant frequency of 1 MHz, although other transducers and piezoelectric materials such as AC, X, and Y cut quartz and various cuts of lithium niobate are also usable. Similarly, other transducers having other resonant frequencies are also usable. As best shown in FIG. 3, the metallized portion 40 of the front surface of the transducer is concentric with the transducer and covers only a portion of that transducer surface. More specifically, the center of the electrode 33 should be within 1/10 the radius of the transducer from the center of the transducer. Also shown in FIG. 3 is an extension 42 of the electrode pattern on the front surface. A similar extension can be made on the electrode on the back surface of the piezoelectric crystal. The purpose of those extensions is to facilitate the establishment of electrical contacts to the piezoelectric transducer to join the center portion of the electrodes with the bias voltage $V_E$ from the LCU. The purpose of this pattern is to allow electrical contact to be made to the electrode; however, any alternative way of establishing electrical contact, such as attaching fine wires or contacting electrically conducting elastomers or by mechanically contacting the electrode with an electrical conductor, would all be viable alternatives. The size of the electrode pattern is not critical but should be of sufficient size so as to allow the transducers to be properly biased during the development process. In FIG. 3, the front surface 40 of the metallized portion has a diameter of 0.90 cm. while the diameter of the whole piezoelectric crystal 32 is 1.65 cm.

In the preferred embodiment, the electrode-bearing transducer was prepared by evaporating a metal onto an appropriately cut crystal, while limiting the area metal deposition onto the crystal with an appropriately designed mask. Alternatively, the metal can be deposited by sputtering, e-beam deposition, spraying an electrically-conductive paint, or any other equivalent method. The thickness of the coverage of the metal is not critical, but it should be sufficiently thick to allow complete coverage of the metallized area and provide the required conductivity. In addition, the electrode material should not exhibit excessive wear characteristics when placed in a development station. Lastly, it should be understood that the coating should not be so thick as to add significant mass to the transducer or in any way damp its oscillations. Typically, coatings having a thickness of between a few hundred and a few thousand angstroms were found to be preferable.

The metallized coating can be comprised of any suitable conductive material which can be deposited according to the methods set forth above. The preferred material is aluminum, although any suitable metal or alloy can be used. Examples of other materials include silver, chrome, gold-chrome, copper, carbon, or a polymeric binder containing a conductor in sufficient quantity so that the dry version of the "paint" is conducting.

Figure 4:
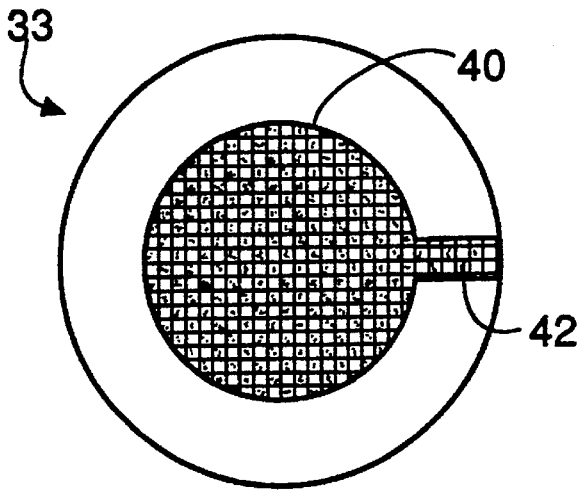
FIG. 4 illustrates a further embodiment of an electrode comprised of an array of small conductive squares of equal size.
Figure 5:
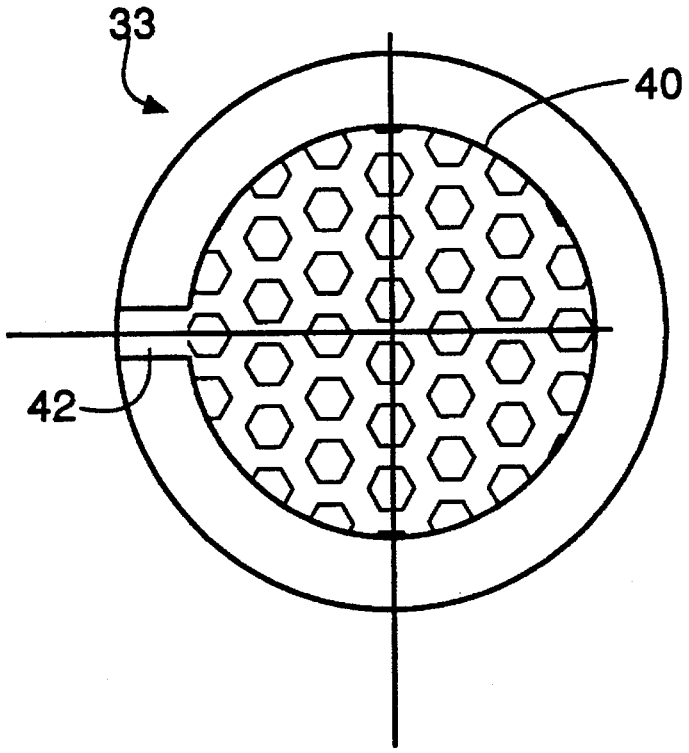
FIG. 5 is a further embodiment showing an alternative pattern of reduced metallization for the central portion of an electrode.

The reduced area of metallization can also be produced by removing part of the front surface electrode by masking the desired portion of the transducer so that the entire front surface of the crystal is coated with the conductor and then removing the unmasked portion by etching in an acid bath or similar technique. A final method of reducing the area of metallization is by abrating the metal from the front surface of a fully metallized transducer in the undesired areas. FIGS. 4 and 5 illustrate further embodiments showing an electrode 33 with the metallized portion of the front surface 40 having its coverage further reduced by forming it as a half-tone pattern. The advantage of using this half-tone pattern is that it utilizes the effect of the electric fringing fields to enhance the rate of toner deposition, thereby making individual measurements faster and at a higher level of completion. The configuration of the half-tone is not critical. However, patterns laid down at fewer than 15 dots/inch may be too crude to provide satisfactory measurements. Similarly, patterns laid down with greater than 65 dots/inch may be too fine. Preferably, them would be approximately 30± 5 dots/inch so that the percent coverage is greater than 50%, but less than 90%. Coverages lower than 50% do not allow a continuous electrode pattern to be formed and coverages greater than 90% do not have sufficient fringe fields to be of any benefit. Therefore, the preferred embodiment has a half-tone coverage of 70±10%. The halftone pattern can be formed by any suitable method such as those previously outlined above.

While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. In an electrostatographic recording device in which latent electrostatic images on an image-recording element are developed by a toner applicator which operates to apply a mass of electrostatically charged toner particles to the image-bearing surface of the image-recording element, said toner applicator being electrically biased to a predetermined potential, an apparatus for determining the rate at which toner particles are applied to the image recording, said apparatus comprising:

a piezo device having a first metallized surface and a second metallized surface, the second metallized surface opposed to the first metallized surface and positioned with said second metallized surface adjacent to said toner applicator to attract a mass of toner particles;

means for selectively biasing said piezo device to a predetermined potential to cause a monolayer of toner particles to be deposited on said second metallized surface; and means for selectively sensing the rate of toner deposition on said second surface by repeatedly sensing the change in resonant impedance of said piezo device, wherein the area of the first metallized surface is greater than the area of the second metallized surface thereby increasing the sensitivity to the mass of the toner particles deposited on the piezo device.

2. The apparatus as set forth in claim 1 wherein the piezo device is circular in shape.

3. The apparatus as set forth in claim 2 wherein the first and second metallized surfaces are circular in shape and are substantially concentric with one another.

4. A piezo device to be positioned adjacent a toner applicator in an electrostatographic recording apparatus in contact with toner particles, said piezo device comprising:

a circular crystal having a first metallized surface and a second metallized surface, said second metallized surface being directed toward said toner applicator and having an area concentric with, and smaller in area than, said first metallized surface.

5. The piezo device as set forth in claim 4 wherein the second metallized surface is between approximately ⅖ to ⅔ the radius of the first metallized surface.

6. The piezo device as set forth in claim 5 wherein the second metallized surface is made up of a plurality of small discrete conductive areas, all of which are electrically connected to one another.

7. The piezo device as set forth in claim 6 wherein the small discrete conductive areas have a density of at least 15 dots per inch but not greater than 65 dots per inch.

8. The piezo device as set forth in claim 6 wherein the plurality of discrete conductive areas take the form of a 50% halftone screen pattern made of an array of conductive squares with their corners touching and electrical contact is made to one of the conductive squares.

9. The piezo device as set forth in claim 8 wherein the array of conductive squares is greater than 50% coverage but less than 90% coverage of the total area.

10. The piezo device as set forth in claim 8 wherein the line ruling of the halftone screen pattern is 30±5 dots per inch.

11. The piezo device as set forth in claim 8 wherein the array of conductive squares is 70%±10% coverage of the total area.

12. The piezo device as set forth in claim 1 wherein the change in impedance can be found by measuring the change in resonant frequency of said piezo device.

* * * * *